United States Patent [19]

Sato

[11] 4,205,607

[45] Jun. 3, 1980

[54] CONSTANT PRESSURE PRINTING MECHANISM FOR PORTABLE LABEL PRINTING MACHINE

[75] Inventor: Yo Sato, Tokyo, Japan

[73] Assignee: Kabushiki Kaisha Sato, Tokyo, Japan

[21] Appl. No.: 909,450

[22] Filed: May 25, 1978

[30] Foreign Application Priority Data

May 27, 1977 [JP] Japan ..... 52-061219
Jun. 7, 1977 [JP] Japan ..... 52-066286

[51] Int. Cl.[2] ..... B41J 5/00

[52] U.S. Cl. ..... 101/291; 156/384; 101/93.02; 101/298; 101/316; 400/687; 400/166; 400/167

[58] Field of Search ..... 156/384; 101/287, 288, 101/291, 292, 316, 297, 298, 10, 20, 93.02, 93.03; 400/153.3, 166, 167, 388, 388.1, 389, 397, 424, 428, 435, 437, 440.2, 648, 649, 652, 686, 687; 267/158; 227/132; 74/97, 2; 173/118, 120, 139; 251/75, 76–78, 80, 251, 262, 263

[56] References Cited

U.S. PATENT DOCUMENTS

| | | | |
|---|---|---|---|
| 1,952,192 | 3/1934 | Atti | 400/428 |
| 3,408,931 | 11/1968 | Austin | 101/318 |
| 4,072,105 | 2/1978 | Becker et al. | 101/288 |
| 4,125,420 | 11/1978 | Hamisch, Jr. | 101/288 |
| 4,125,421 | 11/1978 | Hamisch, Jr. | 101/288 |

*Primary Examiner*—William Pieprz
*Attorney, Agent, or Firm*—Ostrolenk, Faber, Gerb & Soffen

[57] ABSTRACT

A constant pressure printing mechanism for a portable label printing machine, or the like, comprising a driving member which is disposed on either the movable hand lever or the stationary hand grip of the label printing machine and a pressure receiving member which is disposed on the other of the hand lever or the hand grip. The invention uses stored energy derived from a manual squeezing operation to produce the printing stroke, independently of the intensity and duration of a manual squeeze. In one form, the driving member comprises a movable roller, a guiding means to allow the movable roller to move therethrough and an elastic means which always urges the movable roller in one direction and the pressure receiving member comprises a contact surface and an arcuate surface to be brought into contact with the above movable member when the hand lever is squeezed. In another form, the driving member is provided with a spring-actuated projection member and the pressure receiving member is provided with a contact surface and an engaging recess, which are brought into engagement with the projection member.

16 Claims, 6 Drawing Figures

CONSTANT PRESSURE PRINTING MECHANISM FOR PORTABLE LABEL PRINTING MACHINE

BACKGROUND OF THE INVENTION (1) Field of the Invention

This invention relates to a constant pressure printing mechanism for use in a portable label printing machine, or the like.

(2) Description of the Prior Art

Prior constant pressure printing mechanisms have been complicated in structure with a large number of parts. This has led to frequent breakdowns. In addition, fine regulations or adjustments were required to control printing pressure. Therefore, substantial skill was required for the operation and maintenance of such prior constant pressure printing mechanisms and such skill was not ordinarily available at the point of use by unskilled store clerks, or the like.

With portable label printing machines which are not provided with a constant pressure printing mechanism, the darkness of the printed characters and the even toning or printing of labels depends upon the intensity of squeezing or operation of hand lever squeezing. Therefore, printing of characters of even intensity and stable toning or application of ink is quite difficult to attain. When the hand lever of such a label printing machine is squeezed strongly, the printed characters on the labels become very dark. On the other hand, when the hand lever is squeezed weakly, the printed characters on labels become faint. In addition, variations occur not only from label to label but also in the shading and toning of the printing on individual labels.

In recent years, P.O.S. (point of sales) systems have widely been employed in various commercial fields in which the information that is printed on labels is read out electro-optically and not by the naked eye. Therefore, precise and clear printing of labels has become essential in such cases.

BRIEF SUMMARY OF THE INVENTION

It is, therefore, the principal object of the present invention to provide an improved constant pressure printing mechanism for use in a portable label printing machine, or the like.

It is another object of the present invention to provide such a constant pressure printing mechanism which consists of a relatively small number of necessary parts and is simple in structure and operation.

It is a further object of the present invention to provide such a constant pressure printing mechanism with which clear, precise and stable printing of labels can be attained under the inertia of the hand lever squeezing action, regardless of the intensity of the applied squeezing operation.

Still a further object of the present invention is to provide a constant pressure printing mechanism which can be operated easily without any trouble for a long period of use and without the need for adjustment.

In accordance with the present invention, the constant pressure printing mechanism is preferably formed in a portable label printing machine of the type in which a hand lever is pivotally secured in relation to a hand grip. A printing head, which is opposed to a platen, is disposed at the front end portion of the hand lever. By squeezing the hand lever toward the hand grip, the printing head is moved toward the label which is supported on the platen, thereby printing the label.

The constant pressure printing mechanism of the present invention is comprised of a driving member which is disposed on a portion of one of the hand lever and the hand grip, and a pressure receiving member which is disposed on a portion of the other of the hand lever and the hand grip. The driving member includes a pressure member which is biased such that when the pressure member engages the pressure receiving member and greater squeezing force is applied to the hand lever, the pressure member shifts, and in doing so, increases the biasing force applied to the pressure member. The pressure receiving member is shaped such that eventually, the pressure member is suddenly released from having its motion resisted and the resistance to shifting of the hand lever change suddenly, thereby causing the hand lever to shift the printing head toward the platen with the released stored energy. An appropriate formation on the pressure receiving member enables this releasing action. Because the pressure member is on one of the hand grip and the hand lever and the pressure receiving member is on the other of the hand grip and hand lever, and because the hand grip and lever are pivotally connected, as the grip and lever move together, the pressure member slides along the pressure receiving member until the location at which the resistance to shifting of the hand lever is suddenly released.

In one embodiment, the driving member comprises a movable roller which serves as the pressure member, a guiding means which allows the movable roller to move therethrough and biasing means which always urges the movable roller pressure member in one direction. The pressure receiving member comprises a contact surface and an arcuate surface to be brought into contact with the movable roller of the driving member when the hand lever is squeezed. The printing head is moved toward the platen under a constant pressure by the interaction between the movable roller of the driving member and the arcuate surface of the pressure receiving member when the hand lever is squeezed for printing.

In a preferred version of the first embodiment, the driving member comprises a pair of movable rollers or pressure members, a pair of guiding slots as the guiding means and a pair of tension springs as the biasing means, and the pressure receiving member comprises a pair of contact surfaces and a pair of arcuate surfaces. The formation comprises the end of the pressure receiving member being shaped, e.g. like a recess or with a drop off, to permit the pressure member rollers to fall free of engagement with the contact surfaces adjoining the drop off or recess.

In accordance with another embodiment, in the constant pressure printing mechanism of the invention, the driving member is provided with a spring-actuated projection member or pressure member and the pressure receiving member is provided with a contact surface and with a formation in the form of an engaging recess, and these are brought into engagement with the projection or pressure member of the driving member. When the hand lever is squeezed in the label printing, the printing head is driven toward the platen under a constant pressure by the inertia that is caused upon the engagement between the projection or pressure member and the engaging recess.

BRIEF DESCRIPTION OF THE DRAWINGS

Other objects and features of the present invention will be apparent from the following description of the invention with reference to the accompanying drawings, in which.

DESCRIPTION OF THE PREFERRED EMBODIMENTS

Referring to the accompanying drawings, the preferred embodiments of the present invention are described in detail.

Figure 1:
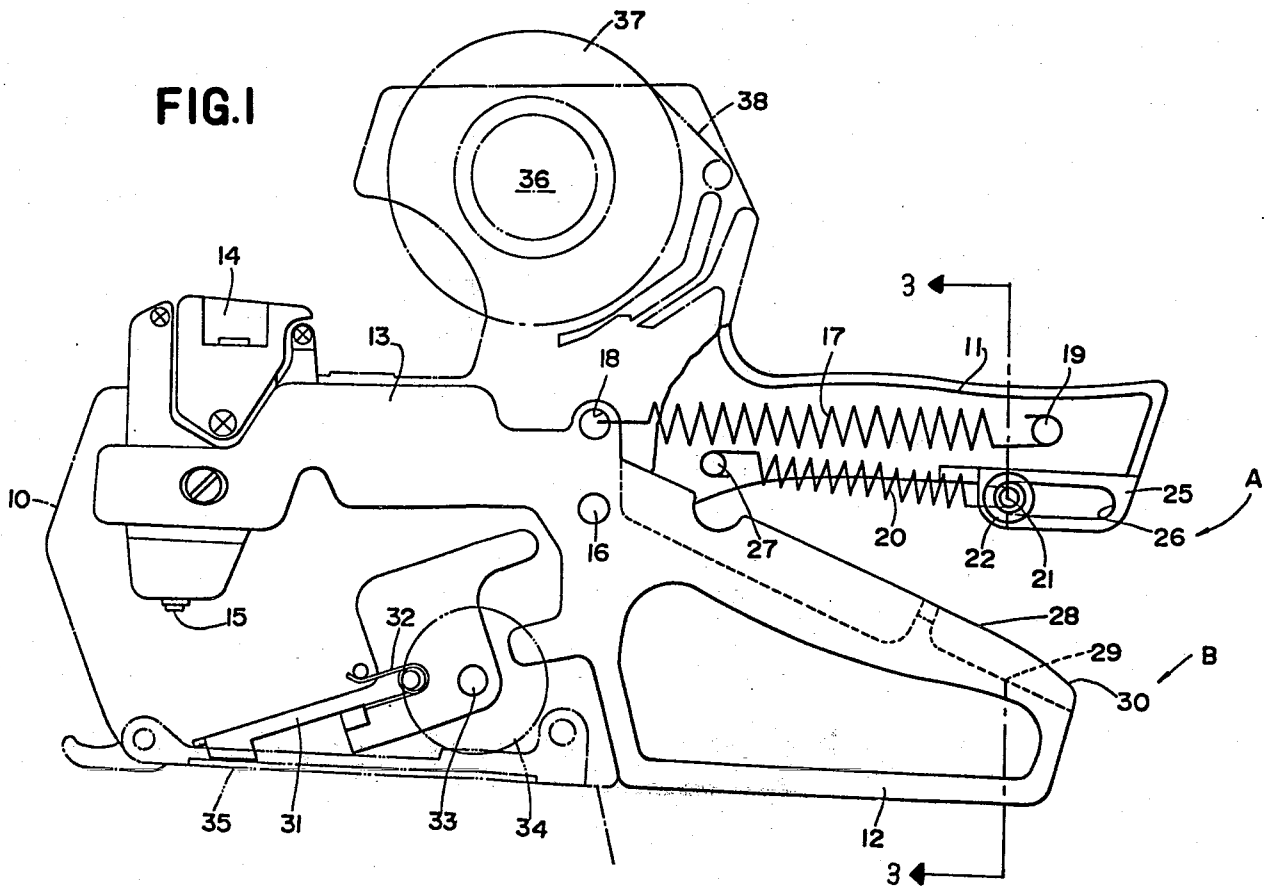
FIG. 1 is a side elevational view of a portable label printing machine, which is provided with one embodiment of the constant pressure printing mechanism of the present invention shown in the rest position.

The label printing machine shown in FIG. 1 includes the label printing machine frame 10 which carries a rearwardly (to the right in FIG. 1) extending hand grip 11 which comprises a driving member A. The machine frame 10 also carries the rearwardly extending hand lever 12 which constitutes the pressure receiving member B. Hand grip 11 and hand lever 12 are in the same plane and are opposed to each other. The hand lever 12 can be rocked up and down in FIG. 1 relative to the hand grip 11 about the fulcrum of a pivot shaft 16, which is fixedly positioned between the opposed side plates of the machine frame 10.

The front (left in FIG. 1) end of the hand lever 12 is integrally provided with bifurcated yoke arms 13, which carry a printing head 14 between them. Printing head 14 has a series of type faces 15 on its bottom surface facing toward the platen 31.

A tensioned return spring 17 carried by the hand grip 11 and extends between a spring mounting opening 18 formed in the front end portion of the hand lever 12 above fulcrum pin 16 and a spring pin 19 formed on the inside wall of the hand grip 11. The hand lever 12 is thus always biased clockwise into the open or released position relative to the hand grip 11. In the released position of the label printing machine, the printing head 14 attached to the yoke arms 13 is accordingly held up away from the platen.

The lower part of the hand grip 11 is provided with a driving member A which comprises a guiding member 25 and movable rollers 22, which are the pressure members and are mounted on a shaft 21. Rollers 22 extend into guide slots 26 (see FIG. 3) and are guided by the guide member 25, as hereinafter described. A tension spring 20 biases the movable rollers or pressure members 22 to the return or open position at the front of slots 26, as shown in FIG. 1.

Figure 3:
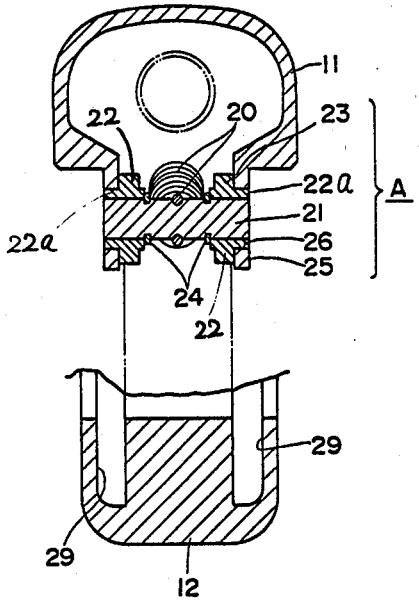
FIG. 3 is a vertical cross-sectional view of the main part of the constant pressure printing mechanism, viewed along line 3—3 of FIG. 1.

As shown in FIG. 3, the member A has a pair of movable rollers or pressure members 22, which are fitted to opposite ends of the shaft 21. Each of the rollers 22 is positioned by a retainer 24 carried on shaft 21 on one side of each roller 22. The other side of each roller 22 bears against the flange 23 on the inside wall of the hand grip 11. The guide member 25 is the rear bottom section of the hand grip 11 and is provided with a slot 26 which receives therein the cylindrical extension 22*a* of the movable roller 22.

One end of the tension spring 20 is attached to the shaft 21 which carries the movable rollers 22. The other end of the spring 20 is attached to a spring pin 27, which is formed on the inside wall of the hand grip 11. The tension or bias of the spring 20 always urges the movable rollers 22 toward the root portion of the hand grip 11, i.e., toward the left with respect to FIG. 1.

The hand lever 12 is provided with a pressure receiving member B which comprises a contact surface 28, which is brought into contact with the above mentioned movable roller 22. The rear end portion of the hand lever 12, which to the rear end of the contact surface 28, is rounded to form arcuate surfaces 30 to facilitate the movement of the movable rollers 22 on and along the surfaces 30. To the rear of the surface 30, the hand lever drops away, defining a formation or recess into which the rollers 22 may drop so as to preclude the rollers 22 exerting further force to bias the hand lever and hand grip apart, once they have been moved together a predetermined distance.

A pair of relief grooves 29 are formed in the upper surface of the hand lever 12 which is opposed to the hand grip 11, so as to receive the guide members 25 therein with clearance.

Constant pressure printing by the types 15 of printing head 14 against a label on the opposed platen 31 is carried out by the mutual action between the driving member A and the pressure receiving member B.

A label feeding roller 34 is supported by a main shaft 33 at the bottom center of machine frame 10 and is intermittently turned on each release of the hand lever 12 after squeezing by feed means well known in this art. A platen 31 is pivotally secured to main shaft 33. Platen 31 is resiliently urged toward the bottom cover 35 that is attached in the bottom portion of the machine frame 10 by means of a spring 32.

A label holder 36 for carrying a rolled label strip 37 is formed in the upper middle portion of the machine frame 10 adjacent to the hand grip 11. From the label holder 36, the tape-like label strip 38 is fed to the feeding roller 34 by way of a label guide member (not shown). Thus, the label strip 38 is intermittently fed onto the platen 31 by the length of one label for each intermittent rotation of the feeding roller 34.

The operation of the first embodiment of the label printing machine is now described, particularly with respect to FIG. 1:

When the hand lever 12 is squeezed, it is rotated upwardly toward the hand grip 11 about the fulcrum of pivot shaft 16. The printing head 14 that is carried by the yoke arms 13 is accordingly moved down toward the platen 31. When the hand lever 12 is further squeezed, the contact surface 28 of the hand lever 12 comes into contact with the movable rollers 22 of the driving member A on the underside of the hand grip 11. The movable rollers 22 are then moved by the surface 28 toward the free end of the hand grip 11 in the slot 26 and against the force of the tension spring 20.

Figure 2:
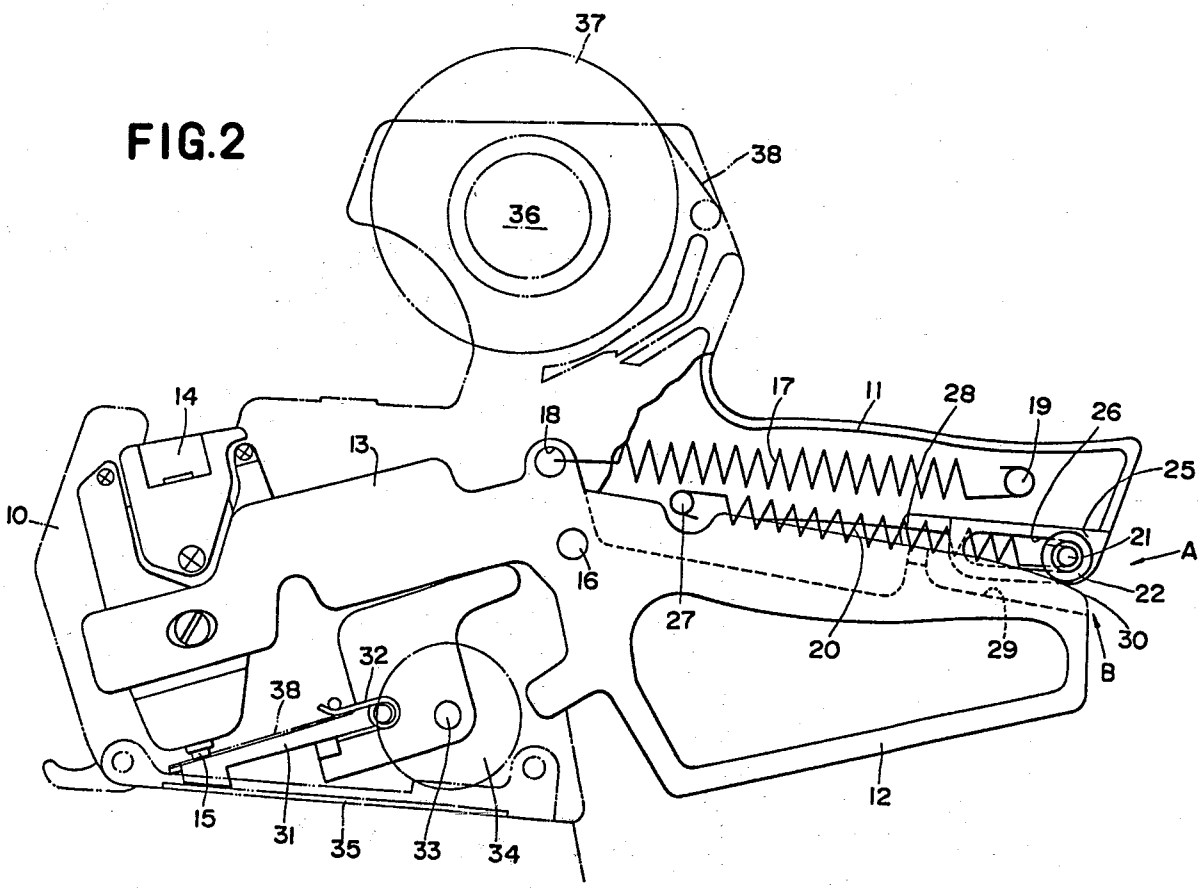
FIG. 2 is the same view as FIG. 1 with the machine in the printing position (its actuated state)

As the hand lever 12 is squeezed still further, the movable rollers 22 eventually reach the arcuate surface 30 that is formed on the rear end portion of the contact surface 28 of the hand lever 12. Immediately thereafter, the movable rollers 22 slip over the arcuate surface 30, and the hand lever 12 is abruptly rotated upwardly. As shown in FIG. 2, this brings the type faces 15 of the printing head 14 into contact with the label strip 38 held on the platen 31 and prints the label then on the platen.

In the return motion of the label printing machine, when the hand lever 12 is released, the hand lever 12 is rotated down and the printing head 14 is moved up by the force of the return spring 17. Further, the movable rollers 22 are pulled back toward their rest position shown in FIG. 1 by the tension spring 20.

In the above-described embodiment, the driving member A, having the movable rollers 22, is disposed on the hand grip 11, while the pressure receiving member B, having the arcuate surfaces 30 to receive the movable rollers 22, is disposed on the hand lever 12. It is to be noted, however, that the positions of the members A and B may be disposed reversely. Further, other positions of the members A and B are possible within the scope of the present invention.

The following advantages are achieved with the first embodiment.

(1) When the hand lever is squeezed, the movable rollers or pressure member 22 of the driving member are first brought into contact with the contact surfaces of the pressure receiving member. The movable rollers or pressure member are then shifted toward the rear end portion of the driving member until the movable rollers finally reach the arcuate surfaces 30 of the pressure receiving member. As the rollers 22 fall off at the arcuate surfaces 30, the hand lever is squeezed further abruptly at a greater rate so that the printing head is brought into contact with the label carried on the platen under the inertia of the force of this relatively sudden movement, as compared with the rate of the printing stroke to that point. Therefore, in contrast with conventional mechanisms, the final printing stroke in the mechanism of the present invention is always constant, and precise and clear printing of labels can be attained without fail.

(2) The intensity of the initial squeezing of hand lever does not have a direct effect on the intensity of the printing stroke. Therefore, irrespective of the intensity of the initial squeezing of hand lever, a constant printing pressure can be exerted to attain the precise printing of labels.

(3) The mechanism of the present invention is simple and the number of parts is small, as compared with prior fully equipped constant pressure mechanisms. The production cost of the mechanism of the invention is therefore low. Adjustment of the mechanism is not required. The operation of the mechanism can be performed without difficulty and without the need for sophisticated training.

Figure 4:
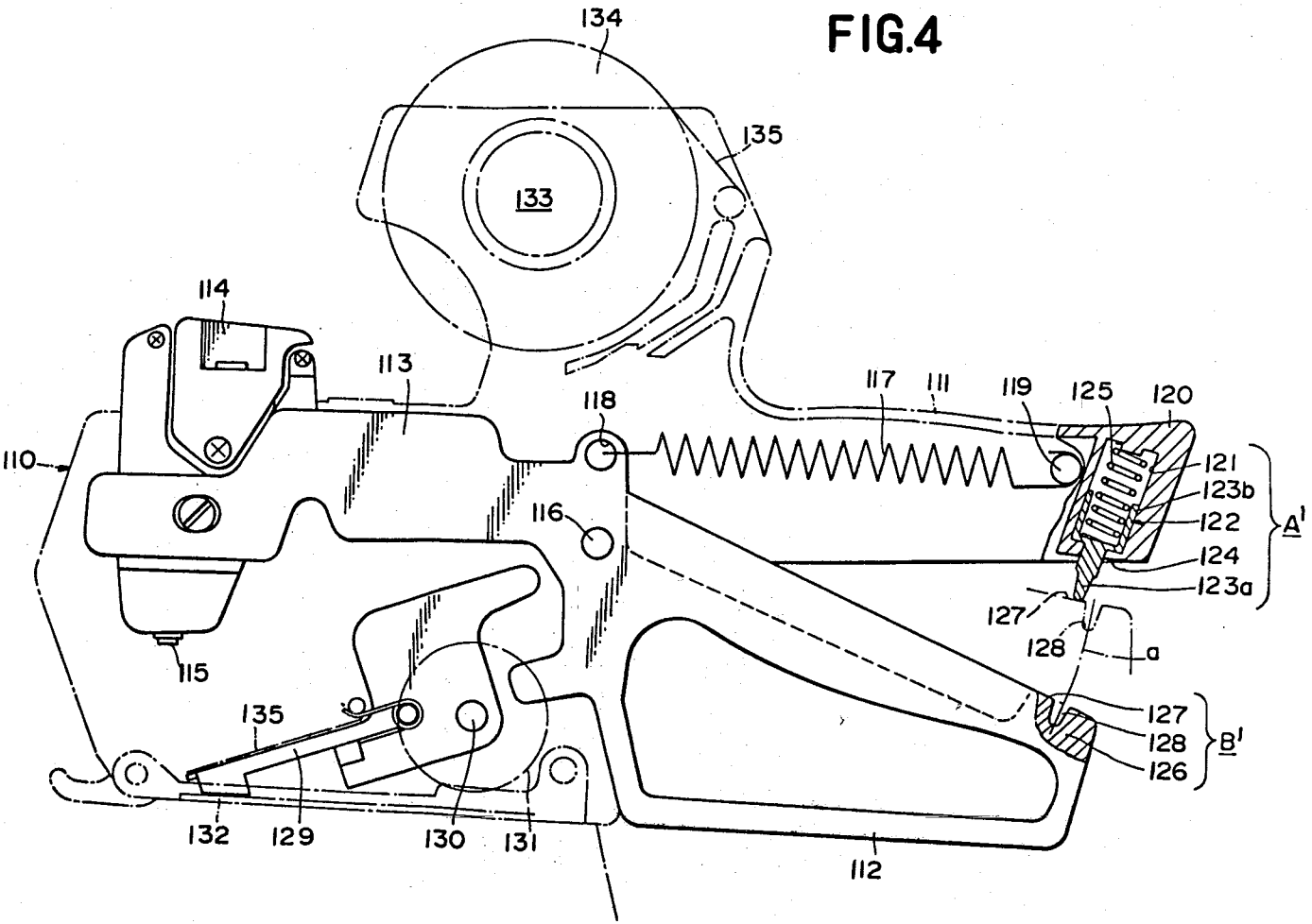
FIG. 4 is a partially cross-sectional, side elevational view of a modified portable label printing machine, which is provided with a modified embodiment of the constant pressure printing mechanism of the present invention and shown in the rest position.
Figure 5:
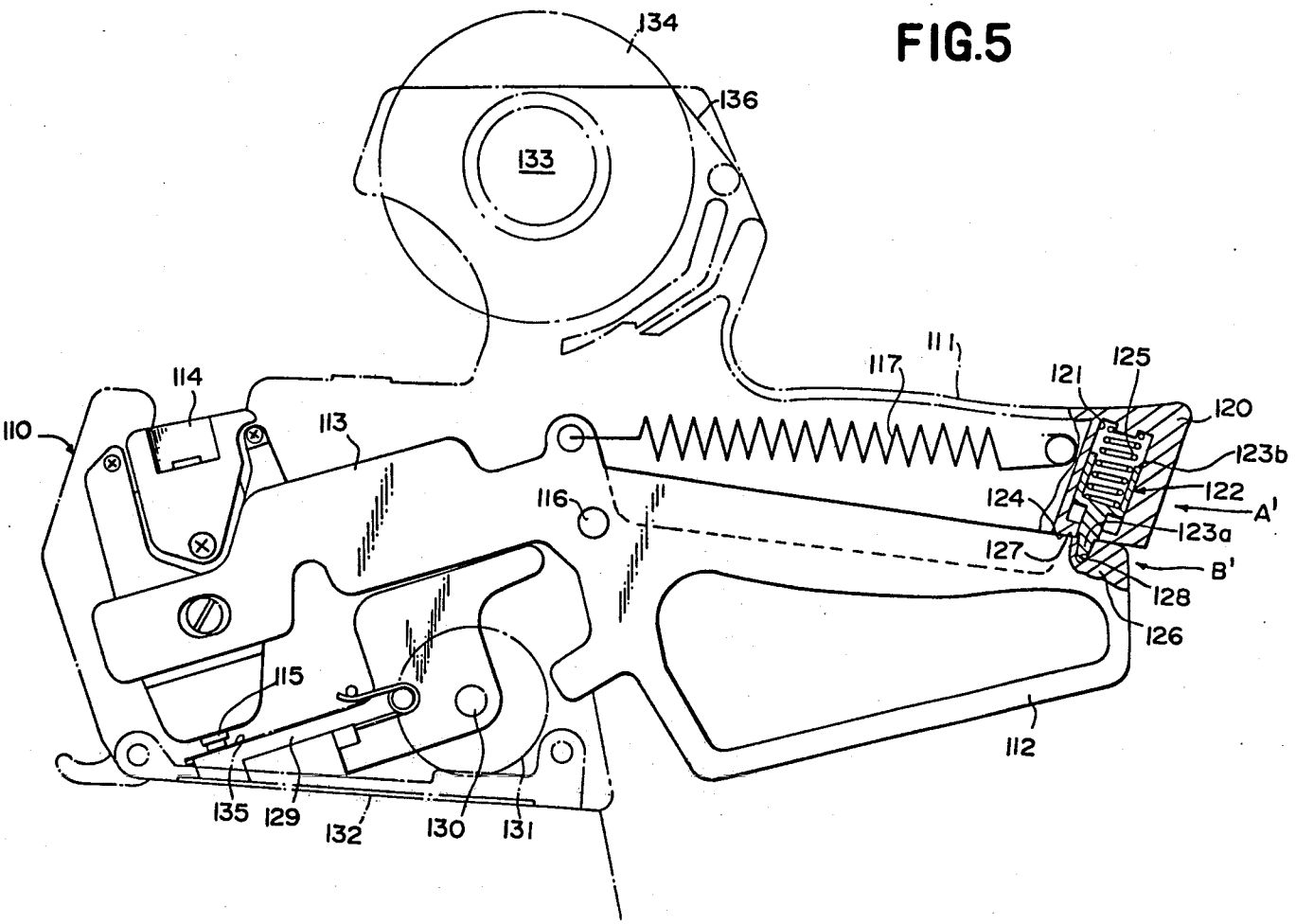
FIG. 5 is the same view as FIG. 4 with the machine in the printing position (its actuated state)
Figure 6:
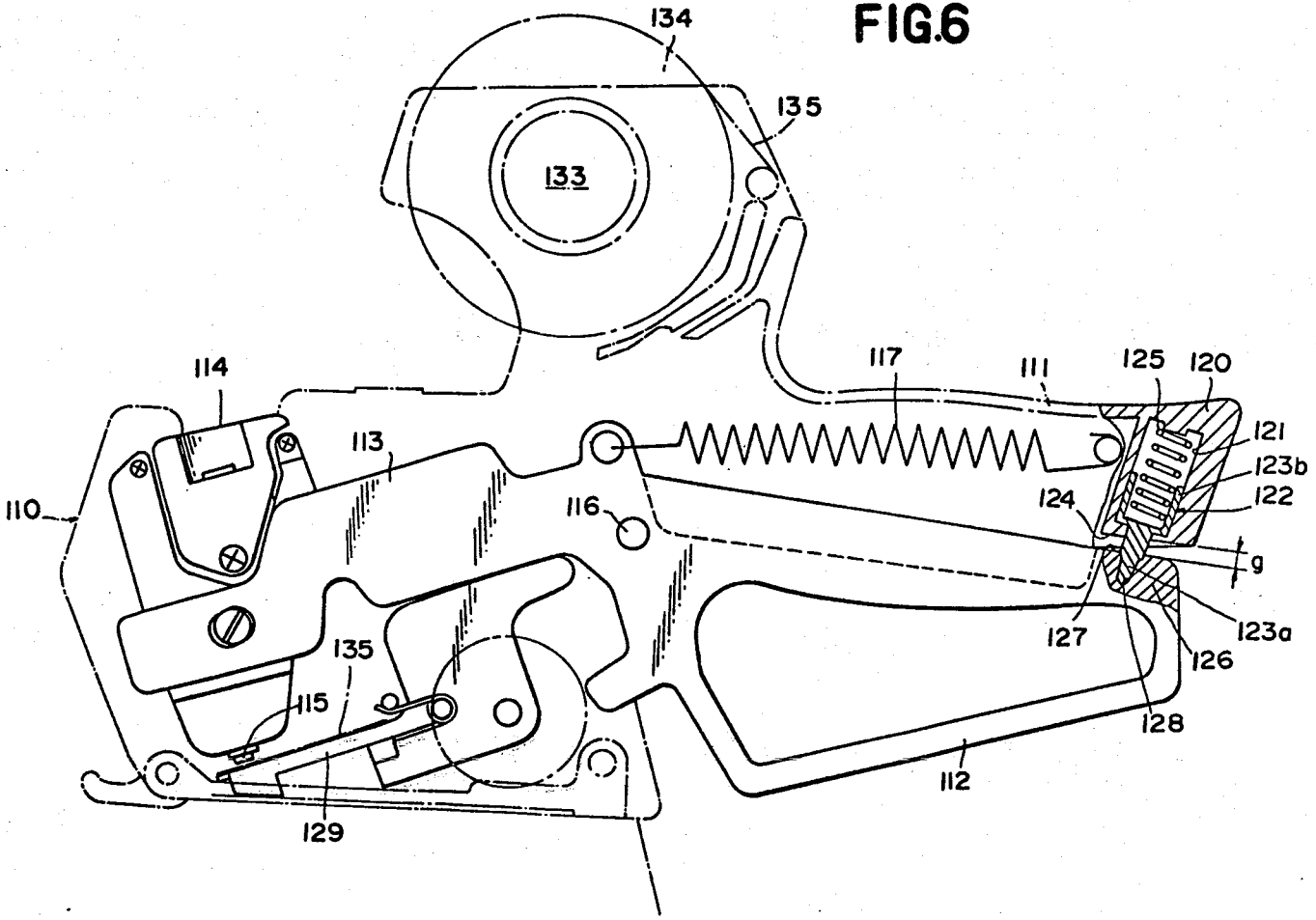
FIG. 6 is the same view as FIG. 5, showing the condition of the machine after printing of a label, and in which the printing head is slightly moved away from the surface of the platen.

In the modified label printing machine shown in FIGS. 4–6, machine frame 110 has a pair of rearward extensions which form the hand grip 111. Grip 111 is integrally provided with a driving member A'. A hand lever 112 is pivotally secured between the side plates of the machine frame 110 using a pivot shaft 116. The hand lever is provided with a pressure receiving member B', which acts in opposition to the driving member A' of the hand grip 111. The hand lever 112 can be rocked up and down relative to the hand grip 111.

The front end portion of the hand lever 112 is integrally provided with bifurcated yoke arms 113 which carry therebetween a printing head 114 having a series of type faces 115 on its bottom side opposed to the platen 135.

A tensioned return spring 117 for the hand lever 112 is carried within the hand grip 111. Return spring 117 is connected between a spring mounting opening formed on the front portion of the hand lever 112 and a spring pin 119 formed inside the hand grip 111. The hand lever 112 is always biased clockwise by return spring 117 into the open position relative to the hand grip 111. In the open or at-rest position of the hand lever 112, the printing head 114 carried by the yoke arms 113 is moved up in the machine body.

The driving member A' comprises a support block 120, which is formed at the rear end of the hand grip 111, a projection member or pressure member 122 having a pin holding section, and a resilient member 125, such as a helical spring or a sponge rubber piece. More particularly, a cylindrical hole 121 is formed in the support block 120. Cylindrical hole 121 has an opening in the bottom side thereof and is tilted so that its lower side is angled forwardly in the machine. The projection or pressure member 122 is fitted inside the cylindrical hole 121 so as to slide freely therealong and in the tilted direction. The resilient member 125 is interposed between the upper end of the cylindrical hole 121 and the upper part of the projection member 122. The projection member 122 is comprised of a pointed end **123*a* and a cylindrical base 123*b*. The resilient member 125 is held within this cylindrical base 123*b***.

The pressure receiving member B' is comprised of a contact surface 127 and an engaging formation, i.e. a recess 128. The contact surface 127 is formed on a pressure receiving block 126, which is disposed at the rear end portion of the hand lever 112. Further, the contact surface 127 is positioned along the extension line of the pointed end **123*a* of the projection or pressure member 122. The position of the engaging recess 128 is determined such that, when the hand lever 112 is squeezed, the pointed end 123*a* of the projection or pressure member 122 first comes into contact with the contact surface 127. Thus, the projection member 122 is pushed up by the contact surface 127 as the hand lever is squeezed further. When the projection member 122 is depressed to a certain extent, the pointed end 123*a* thereof finally falls into the engaging recess 128. In other words, the locus a of the engaging recess 128 is an arc about the fulcrum of the pivot shaft 116, and it is shifted rearwardly, as compared with the position of the pointed end 123*a* of the projection member 122, so that, when the projection member 122 is protruded, the pointed end 123*a* thereof is positioned on the inside of the locus a of the engaging recess 128**.

In the second embodiment of the label printing machine, there is a label feeding roller 131 which is rotatably supported by a main shaft 130 and it is intermittently turned at each release of the hand lever 112 after the hand lever 112 is squeezed. A platen 129 is pivotably secured to this main shaft 130. Platen 129 is disposed in opposition to the type faces 115 of the printing head 14. A label holder 133 for supporting a rolled label strip 134 is formed in the upper middle portion of the machine body adjacent to the hand grip 111. From the label holder 133, the tape-like label strip 135 is fed on and caught by the feeding roller 131 by way of a label guide member (not shown) and the label strip 135 is then fed onto the platen 129.

With reference to FIG. 4, the operation of the second embodiment of the present invention is described. When the hand lever 112 is squeezed, the hand lever 112 and the printing head 114 are turned counterclockwise about the pivot shaft 116 so that the hand lever 112 approaches the hand grip 111 while the printing head 114 moves toward the platen 129. When the hand lever 112 is further squeezed, as indicated by the dotted line of FIG. 4, the contact surface 127 of the pressure receiving block 126 comes into contact with the pointed end 123*a* of the projection member 122 in the driving member A' that is formed on the hand grip 111.

The projection member 122 is then pushed up against the force of the elastic member 125, at which point the operator of the labeling machine senses a slight resistance from the hand lever 112.

When the hand lever 112 is squeezed still further, the pointed end 123*a* of the projection member 122 that has been driven up moves over to and is abruptly caused to fall into the engaging recess 128 of the pressure receiving block 126, as shown in FIG. 5, whereby the resistance to further squeezing of the hand lever is suddenly released. Therefore, the printing head 114 is abruptly driven counterclockwise about the pivot shaft 116 so that the type faces 115 of the head 14 strike against the label 135 on the platen 29 under a predetermined printing pressure. This abrupt movement of the printing head 114 is caused by the inertia of the squeezing of the hand lever 112.

In the printing position shown in FIG. 5, the contact surface 124 of the support block 120 in the driving member A' and the opposite contact surface 127 of the pressure receiving block 126 in the pressure receiving member B' are brought into close engagement with each other.

In the above operation, since the projection member 122 is pushed up against the resilient force of the resilient member 125, energy is accumulated in the resilient member 125 by the compression thereof. Therefore, as shown in FIG. 6 it is possible that projecting member 122 may be pushed back to some extent by the accumulated energy immediately after the pointed end 123*a* is dropped into the engaging recess 128. Accordingly, the hand lever 112 is pushed back, forming a gap g between the contact surfaces 124 and 127 of the respective blocks 120 and 126. For this reason, the type faces 115 of the printing head 114 are separated without delay from the surface of the label 135 that is held on the platen 129. Therefore, double printing owing to the bouncing of the printing head 114 can effectively be prevented.

In the return movement of the label printing machine, when the hand lever 112 is released, the hand lever 112 and the printing head 114 are moved clockwise by the force of the return spring 117, and the label printing machine returns to the rest position shown in FIG. 4.

The driving member A' of FIG. 4 has the spring-actuated projection member 122 formed on the hand grip 111 and the pressure receiving member B' has the engaging recess 128 to receive the pointed end 123*a* of the projection member 122 is formed on the hand lever 12. These members A' and B' can be disposed reversely, whereby the present invention is not restricted to the above-described embodiment.

The following advantages are obtained from the second embodiment of the present invention.

(1) When the hand lever is squeezed, the projection or pressure member of the driving member is first brought into contact with the pressure receiving surface and the projection member finally drops into the engaging recess. Therefore, the printing head is moved against the platen by the inertia of the squeezing of hand lever. Accordingly, the intensity of the squeezing of the hand lever can be controlled by the interaction between both the driving member and the pressure receiving member. As a result, the printing pressure becomes constant and the labels can always be printed quite clearly.

(2) After the above described constant pressure printing, the type faces of the printing head may be immediately moved away from the surface of the label by the accumulated force of the resilient member of the driving member. The bouncing of the type faces of the printing head on the platen can therefore be avoided, so that double printing can be prevented. Further, blurring of labels with printing ink, owing to maintained squeezing of hand lever, is prevented.

(3) The constant pressure printing mechanism is simple in structure so that it can be easily produced at low cost and can be used for a long time without trouble.

In the foregoing, the basic principle of the present invention has been described in connection with two preferred embodiments. Although the present invention has been described in connection with these preferred embodiments, many variations and modifications will now become apparent to those skilled in the art. It is preferred, therefore, that the present invention be limited not by the specific disclosure herein, but only by the appended claims.

What is claimed is:

1. A printing mechanism for a portable label printing machine, or the like, comprising:

a hand grip;

a hand lever pivotally attached to said hand grip; a printing head attached to said hand lever and movable therewith with respect to said hand grip; a platen supported stationary with respect to said hand grip and being opposed to said printing head such that by squeezing said hand lever, said printing head is moved toward a label which is supported on said platen to print the label;

a constant pressure printing mechanism comprising:

a driving member disposed on a portion of one of said hand lever and said hand grip, and a pressure receiving member disposed on a portion of the other of said hand lever and said hand grip;

said driving member comprising a pressure member for being moved into engagement with said pressure receiving member upon said hand lever moving to said hand grip far enough so that said lever and said grip are a first predetermined distance apart; upon engagement between said pressure member and said pressure receiving member, said pressure member having an initial position; following engagement between said pressure member and said pressure receiving member, as said driving member and said pressure receiving member continue to be rotated toward each other, wherein such rotation is caused by pivoting of said hand lever, said pressure member being shifted in position along said pressure receiving member from its said initial position; said pressure member cooperating with said pressure receiving member for blocking that rotation of said hand lever which permits said printing head to contact a label on said platen;

biasing means connected with said pressure member to be charged as said lever and said grip are moved closer together than said first predetermined distance and as said pressure member is shifted in position, for urging said pressure member to return from its shifted position toward its said initial position;

said pressure receiving member further comprising a formation thereon which is engaged by said pressure member as said pressure member is moved along said pressure receiving member when said driving member has been rotated toward said pressure receiving member by a second predetermined distance after it has been moved over said first distance, and said formation causing said pressure member to immediately cease blocking rotation of said hand thereby lever for permitting said printing head to contact a label on said platen, whereby said printing head and said platen are thereafter freed to move toward each other under the predetermined constant printing pressure, which was sufficient to cause said pressure member to engage said formation.

2. The constant pressure printing mechanism of claim 1, further comprising:

means for increasing the biasing force of said biasing means as said pressure member and said pressure receiving member are rotated toward each other by said hand grip and said hand lever moving toward each other.

3. The constant pressure printing mechanism of either of claims 1 or 2, wherein said formation comprises a recess located at the surface of said pressure receiving member for receiving said pressure member, thereby providing freedom of relative rotational motion to said hand lever and said hand grip.

4. The constant pressure printing mechanism of claim 3, wherein said pressure member comprises at least one movable roller, guiding means for guiding motion of said movable roller therethrough and said biasing means biasing said movable roller in one direction with respect to its said guiding means;

said pressure receiving member comprising at least a contact surface and a recess section adjoining said formation and comprising an arcuate surface to be brought into contact with said movable roller before said roller meets said formation, said biasing means causing said roller to move under controlled pressure into said recess section; said recess section being placed such that as said hand lever and said grip move together, said roller moves out of said recess section and into said formation.

5. The constant pressure printing mechanism of claim 4 wherein said guiding means comprises a guide formed on the one of said hand lever and said hand grip carrying said pressure member and extending transversely to the direction of motion of said hand lever and said hand grip together.

6. The constant pressure printing mechanism of claim 5, wherein said guide comprises a slot and said roller including means extending through said slot and being guided for motion thereby.

7. The constant pressure printing mechanism of claim 5, wherein said driving member is disposed on said hand grip and said pressure receiving member is disposed on said hand lever.

8. The constant pressure printing mechanism of claim 5, further comprising a return spring for normally biasing said hand lever and said hand grip apart.

9. The constant pressure printing mechanism of claim 1, wherein said pressure member comprises a projection from the one of said hand lever and said hand grip carrying said pressure member; said pressure receiving member being on the other of said hand lever and said hand grip carrying said pressure receiving member; said pressure receiving member being provided with a contact surface which is brought into engagement with said projection as said hand lever and said hand grip are brought together; said contact surface adjoining said formation; said biasing means urging said projection toward said contact surface.

10. The constant pressure printing mechanism of claim 7, wherein said formation comprises a recess in said pressure receiving member into which said projection may move as said projection moves along said contact surface.

11. The constant pressure printing mechanism of claim 9, wherein said driving member comprises a support block having a hole defined thereon; said projection being slidably held within and being biased by said biasing means out of said hole.

12. The constant pressure printing mechanism of claim 11, wherein said projection is comprised of a base and a narrower extension and said base of said projection is slidably held within said hole and said narrower extension being urged out of said hole by said biasing means.

13. The constant pressure printing mechanism of claim 12, wherein said hole is cylindrical, said base is cylindrical and said narrower extension is conically tapered.

14. The constant pressure printing mechanism of claim 10, wherein said recess of said pressure receiving member is positioned slightly aside the locus of the movement of said projection.

15. The constant pressure printing mechanism of claim 10, further comprising a return spring for normally biasing said hand lever and said hand grip apart.

16. The constant pressure printing mechanism of either of claims 1 or 2, wherein said biasing means is so positioned and so connected with said pressure member to normally bias said pressure member to bias said hand lever and said hand grip apart once said pressure member engages said pressure receiving member.

* * * * *